US007915840B1

(12) United States Patent
Sharamentov

(10) Patent No.: US 7,915,840 B1
(45) Date of Patent: Mar. 29, 2011

(54) RF POWER RECOVERY FEEDBACK CIRCULATOR

(75) Inventor: Sergey I. Sharamentov, Bolingbrook, IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 1008 days.

(21) Appl. No.: 11/739,265

(22) Filed: Apr. 24, 2007

(51) Int. Cl.
*H05H 7/00* (2006.01)

(52) U.S. Cl. ..... 315/500; 315/5.24

(58) Field of Classification Search ..... 315/5.24, 315/500–505

See application file for complete search history.

(56) References Cited

U.S. PATENT DOCUMENTS

2008/0211431 A1* 9/2008 Mishin et al. ..... 315/505
2010/0038563 A1* 2/2010 Chen et al. ..... 250/503.1
2010/0039051 A1* 2/2010 Clayton et al. ..... 315/501
* cited by examiner

*Primary Examiner* — Don P Le
(74) *Attorney, Agent, or Firm* — Michael J. Dobbs; Bradley W. Smith; John T. Lucas

(57) ABSTRACT

A device and method for improving the efficiency of RF systems having a Reflective Load. In the preferred embodiment, Reflected Energy from a superconducting resonator of a particle accelerator is reintroduced to the resonator after the phase of the Reflected Energy is aligned with the phase of the Supply Energy from a RF Energy Source. In one embodiment, a Circulator is used to transfer Reflected Energy from the Reflective Load into a Phase Adjuster which aligns the phase of the Reflected Energy with that of the Supply Energy. The phase-aligned energy is then combined with the Supply Energy, and reintroduced into the Reflective Load. In systems having a constant phase shift, the Phase Adjuster may be designed to shift the phase of the Reflected Energy by a constant amount using a Phase Shifter. In systems having a variety (variable) phase shifts, a Phase Shifter controlled by a phase feedback loop comprising a Phase Detector and a Feedback Controller to account for the various phase shifts is preferable.

20 Claims, 4 Drawing Sheets

The graph shows power gain coefficient Kp versus reflection coefficient R. R is in percents.

RF POWER RECOVERY FEEDBACK CIRCULATOR

GOVERNMENT INTEREST

The United States Government has rights in this invention pursuant to Contract No, W-31-109-ENG-38, between the U.S. Department of Energy (DOE) and the University of Chicago.

FIELD OF THE INVENTION

The present invention relates to the recovery of reflected RF (radio frequency) energy.

BACKGROUND OF THE INVENTION

The coupling of RF (radio frequency) circuits often causes signal reflection. This reflected signal is captured and sent to a "dummy load," a resistive cell. Normally, RF systems, such as those used in communications, are specifically designed to eliminate or at least minimize signal reflectivity. However, in non-communication RF systems, such as those employed in particle accelerators, reflectivity can be a very serious problem. These systems often have a reflectivity greater than about 80% and as high as about 99%, resulting in large RF energy transfer inefficiencies.

Particle accelerators such as ATLAS (Argonne Tandem-Linac Accelerator System) at Argonne National Laboratory use superconducting resonators. These superconducting resonators have a very high Q (quality factor), and therefore have a very narrow frequency bandwidth. Therefore, careful attention must be made to ensure the resonator resonance frequency is at the frequency of the RF Energy Source (RF drive frequency) supplied to the superconducting resonator. Careful attention must also be made to ensure that the resonator RF field is in phase with the RF Energy Source. For example, the resonators used in ATLAS at Argonne National Laboratory have a loaded Q on the order of $10^7$, and a resonance frequency of 97 MHz plus or minus only a few hertz. Frequencies outside of the resonance frequency have little to no effect.

Unfortunately, the resonance frequency of the superconducting resonators is continuously altered by factors such as cryogenic pressure variations, background mechanical vibrations known as microphonics, and ponderomotive (force from ion movement) detuning.

One method of ensuring the resonator can efficiently utilize RF energy from the RF Energy Source is to overcouple the resonator, effectively increasing the bandwidth of the resonator. By increasing the resonator bandwidth, RF phase errors due to RE resonant frequency variations in the resonator can be reduced.

Unfortunately, when overcoupled, a significant amount of RF energy from the RF Energy Source is reflected back to the RF Energy Source. As the Reflected Energy can potentially damage the RE Energy Source, this Reflected Energy is normally routed through a circulator to a "dummy load" for dissipation. As resonators used in superconducting particle accelerators can have a reflectivity as high as 99%, a very significant amount of energy is lost due to overcoupling.

Another method of ensuring the resonator resonance frequency matches the frequency of the RE Energy Source is to continuously match the resonator frequency using a VCX (voltage controlled reactance) system, VCX systems are generally focused on achieving phase synchronization with the resonance frequency of the resonator.

VCX systems such as those used by ATLAS at Argonne National Laboratory are based on PIN diodes used to switch the superconducting resonator between high and a low frequency states chosen to bracket the resonate frequency. In the high-frequency state, the resonator RF phase processes forward relative to the phase of RF Energy Source, and in the low frequency state, backwards.

Phase control is achieved with a diode driver which switches the diodes between the two states. Within the switching period, the diodes can be turned on for a controlled time, which generally vary from 5% to 95% of the switching cycle. Modulation of the duty factor provides an effectively continuous control of the direction of phase precession, hence also the mean frequency received by the resonator. Unfortunately, VCX systems add additional complexity to the resonator and are problematic in high RF field applications. This additional complexity increases startup costs, maintenance costs, as well as operating costs. These additional components also absorb energy reducing the efficiency of the system, while generating heat.

Therefore, there exists a need for a simple, reliable, low cost, and energy efficient means of recuperating reflected RF energy. More particularly, there exist a need of supplying energy to a superconducting resonator, while minimizing ene loss and system complexity.

SUMMARY OF THE INVENTION

A device and method for improving the efficiency of RF systems having a Reflective Load. Generally, an RF Energy Source supplies a Supply Energy to a Reflective Load. Some energy is reflected off the Reflective Load producing a Reflected Energy. Reflected Energy from the Reflective Load is reintroduced to the Reflective Load after the phase of the Reflected Energy is properly aligned, in the case of a substantially constant phase shift (torn substantially constant reflections off the load), the phase of the Reflected Energy is adjusted by a constant amount to substantially match the phase of the RF Energy Source. In systems having a variety (variable) of phase shifts (from a substantially variable reflections off the load), a phase feedback loop to account for the various phase shifts is preferable.

It is an object of an embodiment of the present invention to increase the efficiency of RF systems by recovering and reusing reflected RF energy. It is another object of an embodiment of the present invention for the efficient and economical energy delivery to a particle accelerator utilizing a superconducting resonator.

Still, it is yet another object of an embodiment of the present invention for the efficient and economical energy delivery to a heavy particle accelerator utilizing a superconducting resonator.

DETAILED DESCRIPTION OF THE INVENTION

A device and method for improving the efficiency of RF systems having a Reflective Load. Generally, an RF Energy Source supplies a Supply Energy to a Reflective Load. Some energy is reflected off the Reflective Load producing a Reflected Energy. Reflected Energy from the reflective load is reintroduced to the reflective load after the phase of the Reflected Energy is properly aligned. In the case of a substantially constant phase shift (from substantially constant reflections off the load), the phase of the Reflected Energy is adjusted by a constant amount to substantially match the phase of the RF Energy Source. In systems having a variety (variable) of phase shifts (from a substantially variable reflections off the load), a phase feedback loop to account for the various phase shifts is preferable.

Figure 1:
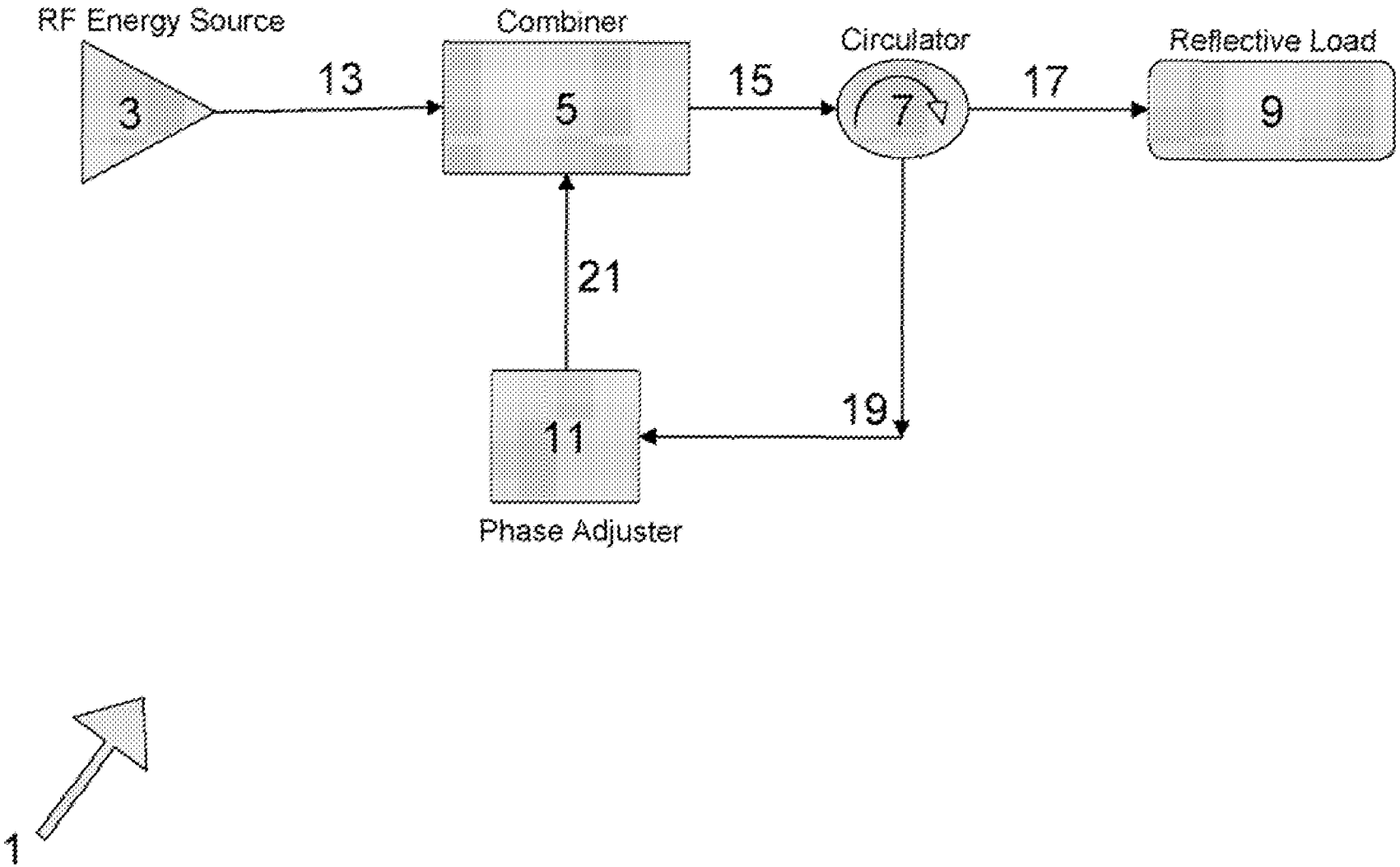
FIG. 1 depicts an embodiment of an RF Power Recovery Feedback Circulator.

An embodiment of an RF Power Recovery Feedback Circulator 1, shown in FIG. 1, generally comprises a RF Energy Source 3, a Combiner 5, an RF Circulator 7, a Reflective Load 9, and a Phase Adjuster 11. The RF Energy Source 3 is connected to the Combiner 5, preferably by a wire 13. The Combiner 5 is connected to the Circulator 7, preferably by a wire 15. The Circulator 7 is connected to the Reflective Load 9, preferably by a wire 17, and the Phase Adjuster 11, preferably by a wire 19. The Phase Adjuster 11 is also connected to the Combiner 5, preferably by a wire 21.

The RF Energy Source 3 generates a Supply Energy. The RF Energy Source 3 is preferably connected to the Combiner by a wire 13, preferably a coaxial cable, or a stripline. In the alternative, waveguides may be substituted for the various wires. For example, in particle accelerator applications, the RF Energy Source 3 generates a Supply Energy in order to feed the Reflective Load 9 (resonator), in order to accelerate charged particles. Preferably, the RF Energy Source 3 produces a Supply Energy of about 10 Watts up to 10 Megawatts depending on the output power desired. In the preferred embodiment, the RF Energy Source 3 is a 1-10,000 MHz generator producing about 10 Watts to about 10 Megawatts of Supply Energy, in the another embodiment, the RF Energy Source 3 produces a Supply Energy of about 10 Watts up to about 10,000 Watts at about 40-200 Mhz. In yet another embodiment, the RF Energy Source 3 produces a Supply Energy in excess of 10 Megawatts.

The Combiner 5 has a First Input Connection, a Second Input Connection and an Output Connection. The Combiner 5 combines RF signals (RF waves) at the First Input Connection and the Second Input Connection into the Output Connection of the Combiner, while minimizing any reflections and energy loss. The First. Input Connection is connected to the RF Energy Source 3, by a wire 13, preferably a coaxial cable, or a stripline. The Second Input Connection is connected to the Phase Adjuster 11, by a wire 21, preferably a coaxial cable, or a stripline. The Output Connection of the Combiner 5 is connected by a wire 15, preferably a coaxial cable, or a stripline, to the Circulator 7. In the alternative, waveguides may be substituted for the various wires.

The Combiner 5 may utilize various designs such as quadrature or hybrid structures. In quadrature structures, the Output Connection of the Combiner 5 is the combination of the First Input Connection and Second Input Connection of the Combiner 5 having a 90 degree phase difference between them. Preferably, the Combiner 5 is selected considering the desired phase shift, frequency range, insertion loss, isolation, and RF connector type. Examples of suitable Combiners include the Combiners described in U.S. Pat. Nos. 6,377,133; 5,892,414; and 5,455,546, hereby fully incorporated by reference.

The RF Circulator 7 comprises an Input Connection (port), and Output Connection (port) and a Reflection Connection (port). The Input Connection connected to the Output Connection of the Combiner 5, by a wire 15, preferably a coaxial cable, or a stripline. The Output Connection (port) is connected to the Reflective Load 9, by a wire 17, preferably a coaxial cable, or a stripline. The Reflection Connection (port) is connected to the Phase Adjuster 11, by a wire 19, preferably a coaxial cable, or a stripline. In the alternative, waveguides may be substituted for the various wires. The RF Circulator 7 transfers energy inputted at the Input Connection to the Output Connection, while minimizing reflections and energy loss. The RE Circulator 7 also transfers energy inputted at the Output Connection to the Reflection Connection, while minimizing reflections and energy loss.

The RF Circulator 7 is preferably a passive microwave ferrite device with three (P1, P2, P3) or four (P1, P2, P3, P4) ports in which the ports can be accessed in such an order that when a signal is fed into any port it is transferred to the next port, in the direction P1-P2-P3-P1 or P1-P2-P3-P4-P1, while minimizing any RF reflections and energy loss. In one embodiment, the RF Circulator 7 is a four port waveguide circulator based on Faraday rotation of propagating waves in a magnetized material, or a three port "turnstile" or "Y-junction" circulator based on cancellation of waves propagating over two different paths near a magnetized material. In the preferred embodiment, the RF Circulator 7 is a three port Y-junction coaxial RF Circulator Examples of suitable RF Circulators includes the RF Circulators described in U.S. Pat. Nos. 3,573,666; 5,384,556; and 5,963,108, hereby fully incorporated by reference.

Figure 4:
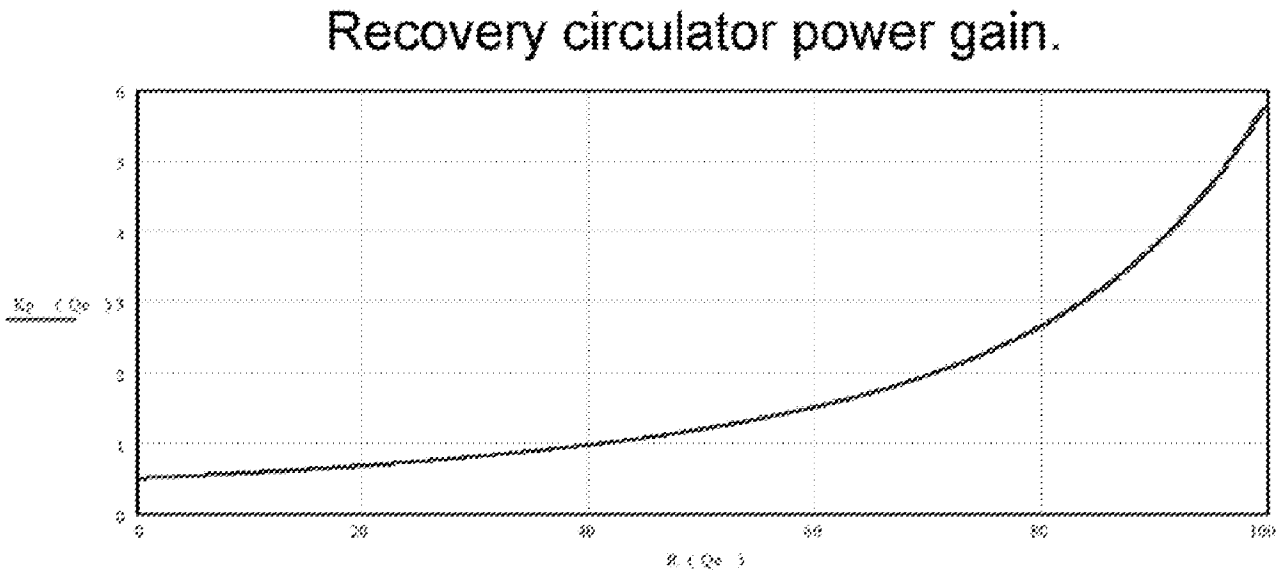
FIG. 4 depicts a graph of the power gain resulting from the preferred embodiment, depending on the reflectivity of the load (in percent).

The Reflective Load 9 is a device capable of absorbing the Supply Energy produced by the RF Energy Source 3 while at least partially reflecting the Supply Energy creating a Reflected Energy. FIG. 4 shows a graph of the power gain resulting from the preferred embodiment, depending on the percentage of reflectivity of the Reflective Load 9. The Reflective Load 9 preferably has a reflection coefficient greater than 41.4%, the unity power gain. In the preferred embodiment, the Reflective Load 9 is a superconducting resonator of a particle accelerator having a Q (quality factor) greater than about $10^6$, more preferably about $10^8$, and even more preferably $10^{11}$. In another embodiment, the Reflective Load 9 is an antenna, or any another RE load known in the art.

The Phase Adjuster 11 has an input Connection and an Output Connection, and aligns the phase of the RF signal at the Input Connection to the phase of the RF Energy Source 3 at the Combiner 5. The Input Connection of the Phase Adjuster 11 is connected to the Reflection Connection of the Circulator 7 by a wire 19, preferably a coaxial cable, or a stripline. The Output Connection of the Phase Adjuster 11 is connected to the Second input Connection of the Combiner 5, by a wire 21, preferably a coaxial cable, or a stripline. In the alternative, waveguides may be substituted for the various wires.

Depending on the Combiner 5, the Phase Adjuster 11 may need to provide a determined phase relationship between the Supply Energy from the RF Energy Source 3 and the Reflected Energy from the Reflection Connection of the Circulator 7 to compensate for any phase modification from the Combiner 5. The Phase Adjuster 11 is preferably a low loss passive device. In systems where the Reflective Load 9 produces Reflected Energy with a constant phase shift, the Phase Adjuster 11 is designed to shift the phase of the Reflected Energy from the Reflected Load 9 (passed through the Circulator 7) by a constant amount. In the case where the Reflective Load 9 produces Reflected Energy having a variety of phase shifts, the Phase Adjuster 11, should be designed to adapt to phase of the Reflected Energy to that of the RE Energy Source 3.

Figure 2:
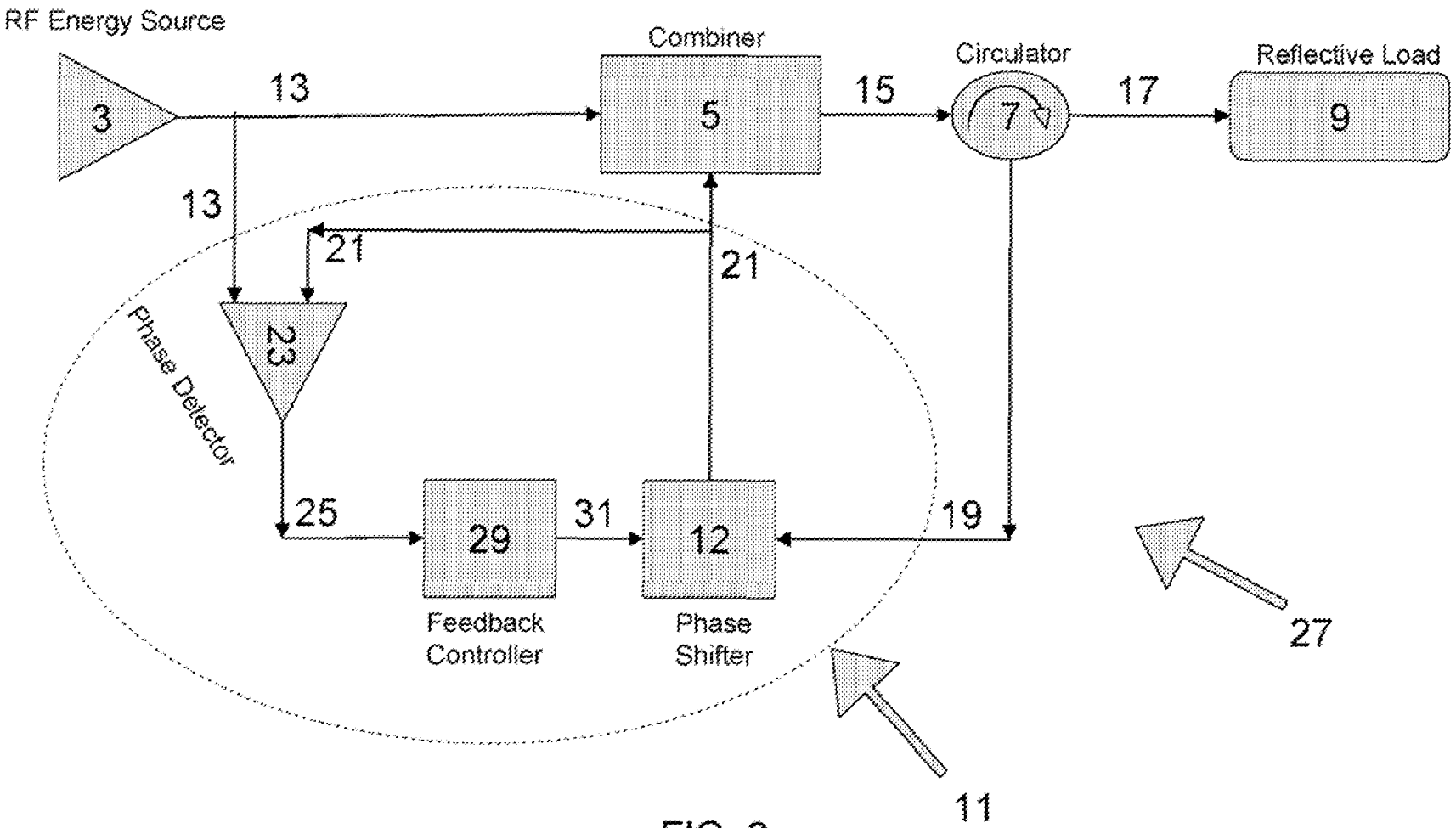
FIG. 2 depicts the preferred embodiment of an RF Power Recovery Feedback Circulator.

For systems having reflectivity with a variety (variable) of phase shifts, the embodiment of an RF Power Recovery Feedback Circulator 27, shown in FIG. 2, is preferable. FIG. 2 shows a Phase Adjuster 11 having a Phase Detector 23, a Feedback Controller 29, and a Phase Shifter 12. The Phase Detector 23 has a First Input Connection, a Second Input Connection and an Output. Connection. The Feedback Controller 29 has an Input Connection and an Output Connection. The Phase Shifter 12 has an Input Connection, Output Connection, and a Control Input Connection.

The Phase Detector 23 and the Feedback Controller 29 form a phase feedback loop controlling the Phase Shifter 12. The First Input of the Phase Detector 23 is connected to the RF Energy Source 3 by a wire 13. The Second Input Connection of the Phase Detector 23 is connected to the Output Connection of the Phase Shifter 12 by a wire 21. The Output Connection of the Phase Detector 23 is connected to the input Connection of the Feedback Controller 29 by a wire 25. The Output. Connection of the Feedback Controller 29 is connected to the Control Input Connection of the Phase Shifter 12 by a wire 31. The input Connection of the Phase Shifter 12 is connected to the Reflection Connection of the Circulator 7. The Output Connection of the Phase Shifter 12 is connected to the Second Input Connection of the Combiner 5 and the Second Input of the Phase Detector 23

The Phase Detector 23 detects the phase difference between the Supply Energy from the RF Energy Source 3 and the phase-adjusted energy from the Output Connection of the Phase Shifter 12 and outputs a signal thereof. In the preferred embodiment, the Phase Detector 23 outputs a DC voltage related to the phase difference of the Supply Energy from the RF Energy Source 3 and the phase-adjusted energy from the Output Connection of the Phase Shifter 12.

The feedback controller 29 stabilizes the phase relationship between the Supply Energy from the RF Energy Source 3 and phase-adjusted energy from the Output Connection of the Phase Shifter 12. Preferably, the feedback controller 29 is a PID (Proportional-Integral-Derivative) controller, or a Digital controller. In the preferred embodiment, the feedback controller 29 amplifies the Phase Detector 23 output to achieve high feedback loop gain and while also stabilizing the feedback loop.

Figure 3:
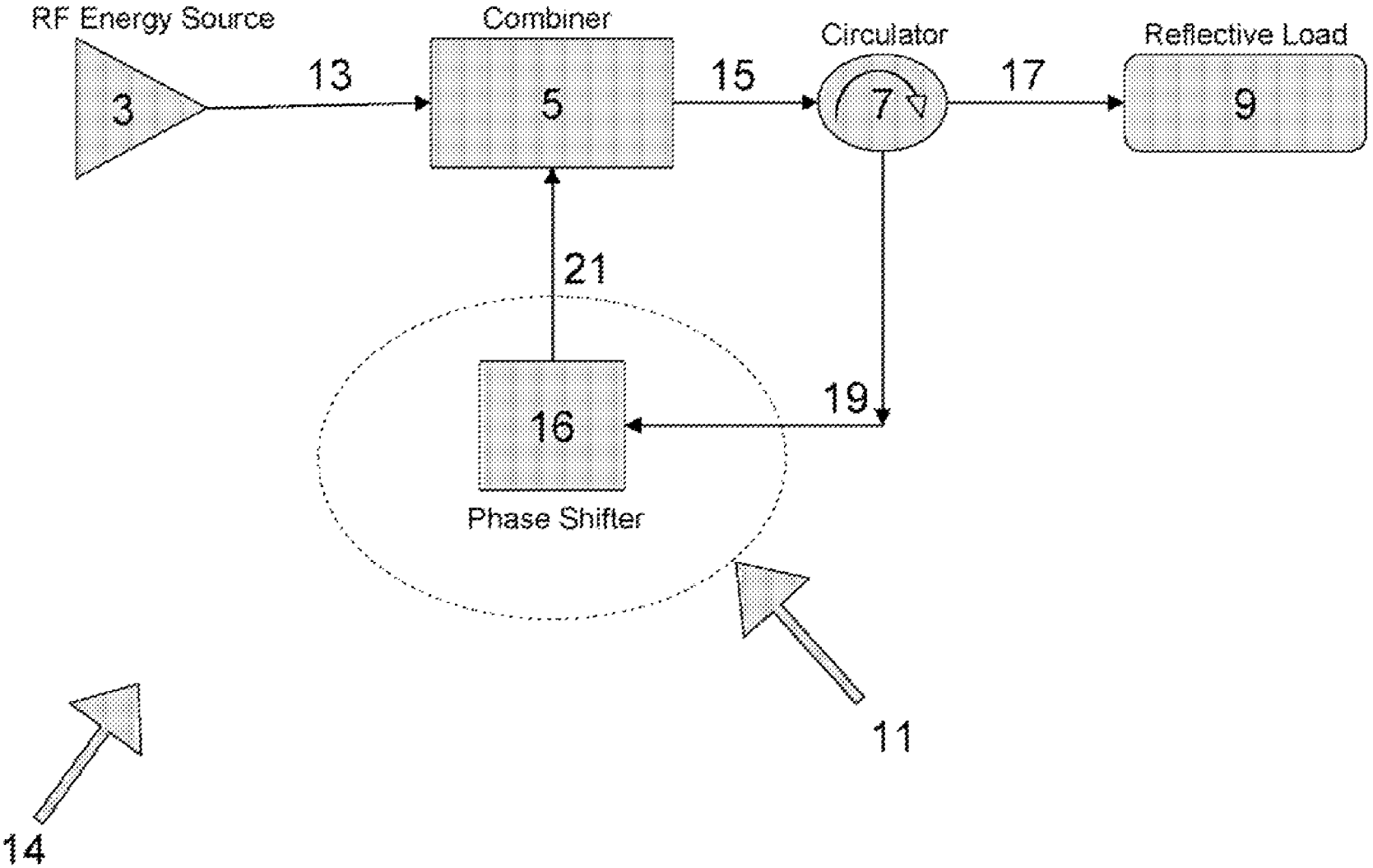
FIG. 3 depicts an embodiment of an RF Power Recovery Feedback Circulator.

In the case where the Reflective Load 9 has a constant reflectivity, whereby energy reflected off the Reflective Load 9 has the same phase adjustment, the Phase Detector 23 and Feedback Controller 29, may be omitted as shown in FIG. 3, in this embodiment 14, the Phase Shifter 16 is selected and configured to adjust the phase of the Reflected Energy from the Reflective Load 9 by the predetermined phase difference between the Reflected Energy of the Reflective Load 9 and the Supply Energy of the RF Energy Source 3.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. For example, Reflected Energy in a communication system may be similarly rerouted to the RF Energy Source of the communications system, reintroduced into the transmission stage of the communication system, or routed directly to the Reflective Load. In yet another embodiment, reflections in a microwave system may be similarly rerouted to the RF Energy Source of the microwave system, reintroduced into the transmission stage of the microwave system or routed directly to the Reflective Load.

All publications and patent documents cited in this application are incorporated by reference in their entirety for all purposes to the same extent as if each individual publication or patent document were so individually denoted.

Any element in a claim that does not explicitly state "means for" performing a specified function, or "step for" performing a specific function, is not to be interpreted as a "means" or "step" clause as specified in 35 U.S.C §112, ¶6. In particular, the use of "step of" in the claims herein is not intended to invoke the provisions of 35 U.S.C §112, ¶6.

The invention claimed is:

1. An RF Power Recovery Feedback Circulator comprising:

a. An RF Energy Source supplying a Supply Energy;

b. A Combiner comprising a First Input Connection, a Second Input Connection, and an Output Connection;

c. Said First Input Connection of said Combiner connected to said RF Energy Source;

d. A circulator comprising an Input Correction, an Output Connection, and a Reflection Connection;

e. Said Output Connection of said Combiner connected to said Input Connection of said Circulator;

f. A Reflective Load producing a Reflected Energy from said Supply Energy connected to said Output Connection of said Circulator;

g. A Phase Adjusting Means for adjusting the phase of said Reflected Energy having an Input Connection and an Output Connection;

h. Said Input Connection of said phase adjusting means connected to said Reflection Connection of said Circulator; and i. Said Output Connection of said Phase Adjuster connected to said Second Input Connection of said Combiner.

2. The RF Power Recovery Feedback Circulator of claim 1 whereby said Phase Adjusting Means comprises a Phase Detector, a Feedback Controller, and a Phase Shifter whereby:

a. said Phase Detector has a First Input Connection and a Second Input Connection and an Output Connection;

b. said Feedback Controller has an Input Connection and an Output Connection;

c. said Phase Shifter having a Phase Control Input Connection, an Input Connection, and an Output Connection;

d. said First Input Connection of said Phase Detector connected to said RF Energy Source;

e. said Second Input Connection of said Phase Detector connected to said Output Connection of said Phase Shifter;

f. said Output Connection of said Phase Detector connected to said Input Connection of said Feedback Controller;

g. said Output Connection of said Feedback Co roller connected to said Phase Control input Connection of said Phase Shifter; and h. said Reflection Connection of said Circulator connected to said Input Connection of said Phase Shifter.

3. The RF Power Recovery Feedback Circulator of claim 1 whereby said Phase Adjusting Means comprises a Phase Shifter whereby:

a. said Phase Shifter has an input Connection, and an Output Connection;

b. said Input Connection of said Phase Shifter connected to said Reflection Connection of said Circulator; and c. said Output Connection of said Phase Shifter connected to said Second Input Connection of said Combiner.

4. The RF Power Recovery Feedback Circulator of claim 1 whereas said Reflective Load is a superconducting resonator.

5. The RF Power Recovery Feedback Circulator of claim 1 whereas said Reflective Load has a reflectivity greater than 41.4%.

6. The RF Power Recovery Feedback Circulator of claim whereas said Reflective Load has a reflectivity greater than about 80%.

7. The RF Power Recovery Feedback Circulator of claim 1 whereas said Reflective Load has a reflectivity of about 99%.

8. The RF Power Recovery Feedback Circulator of claim 1 whereas said Reflective Load has a Q greater than about $10^6$.

9. The RE Power Recovery Feedback Circulator of claim 1 whereas said Reflective Load has a Q greater than about $10^8$.

10. The RF Power Recovery Feedback Circulator of claim 1 further comprising an overcoupling means for overcoupling said Output Connection of said circulator to said Reflective Load.

11. The RE Power Recovery Feedback Circulator of claim 1 whereas said RF Energy Source produces between about 10 Watts and about 10 Megawatts of power.

12. A method of recovering Reflected Energy comprising the steps of:

a. applying a Supply Energy to a Reflective Load;

b. capturing a Reflected Energy from said Reflective Load;

c. aligning and combining the said captured Reflected Energy and the said applied Supply Energy; and d. applying said aligned and combined energy to said Reflective Load.

13. The method of recovering Reflected Energy of claim 12 whereas said Reflective Load is a superconducting resonator.

14. The method of recovering Reflected Energy of claim 12 whereas said Reflective Load has a reflectivity greater than 41.4%.

15. The method of recovering Reflected Energy of claim 12 whereas said Reflective Load has a reflectivity greater than about 80%.

16. The method of recovering Reflected Energy of claim 12 whereas said Reflective Load has a reflectivity of about 99%.

17. The method of recovering Reflected Energy of claim 12 whereas said Reflective Load has a Q greater than about $10^6$.

18. The method of recovering Reflected Energy of claim 12 whereas said Reflective Load has a Q greater than about $10^8$.

19. The method of recovering Reflected Energy of claim 12 whereas said step for applying a Supply Energy to a Reflective Load comprises a step for overcoupleing said Reflective Load.

20. The method of recovering Reflected Energy ref claim 12 whereas step of applying RF energy employs an RF Energy Source producing between about 10 Watts and about 10 Megawatts of power.

* * * * *